US010101109B2

(12) United States Patent
Caudle

(10) Patent No.: US 10,101,109 B2
(45) Date of Patent: Oct. 16, 2018

(54) SUBMACHINE GUN CONVERSION UNIT

(71) Applicant: Carl Caudle, St. Helens, OR (US)

(72) Inventor: Carl Caudle, St. Helens, OR (US)

( * ) Notice: Subject to any disclaimer, the term of this patent is extended or adjusted under 35 U.S.C. 154(b) by 0 days.

(21) Appl. No.: 15/246,214

(22) Filed: Aug. 24, 2016

(65) Prior Publication Data

US 2018/0031343 A1 Feb. 1, 2018

Related U.S. Application Data

(63) Continuation-in-part of application No. 15/221,479, filed on Jul. 27, 2016.

(51) Int. Cl.

| | |
|---|---|
| ***F41A 11/02*** | (2006.01) |
| ***F41A 9/37*** | (2006.01) |
| ***F41A 9/65*** | (2006.01) |
| ***F41A 3/66*** | (2006.01) |
| ***F41A 21/48*** | (2006.01) |
| ***F41C 23/16*** | (2006.01) |
| ***F41A 9/59*** | (2006.01) |

(52) U.S. Cl.

CPC ..... *F41A 11/02* (2013.01); *F41A 3/66* (2013.01); *F41A 9/37* (2013.01); *F41A 9/59* (2013.01); *F41A 9/65* (2013.01); *F41A 21/482* (2013.01); *F41C 23/16* (2013.01)

(58) Field of Classification Search

CPC .... F41A 11/02; F41A 3/66; F41A 9/37; F41A 9/59; F41A 9/65; F41A 21/482; F41A 11/00; F41C 23/16

USPC ..... 89/197, 128

See application file for complete search history.

(56) References Cited

U.S. PATENT DOCUMENTS 3,771,415 A * 11/1973 Into ..... F41A 3/78 42/16
3,776,095 A * 12/1973 Atchisson ..... F41A 11/02 42/16
4,056,038 A * 11/1977 Rath ..... F41A 5/18 42/16
4,058,922 A * 11/1977 Elbe ..... F41A 9/71 42/16
4,169,329 A * 10/1979 Atchisson ..... F41A 11/02 42/16

(Continued)

OTHER PUBLICATIONS

Ian McCollum, Steyr GB, forgottenweapons.com, http://www.forgottenweapons.com/other-handguns/steyr-gb/.

(Continued)

*Primary Examiner* — Joshua E Freeman

(74) *Attorney, Agent, or Firm* — Chernoff Vilhauer, LLP

(57) ABSTRACT

A conversion unit for converting an AR-15 style military assault rifle to a submachine gun includes a central assembly having a magazine well and rear barrel mount. The magazine well can be inserted downwardly into the lower receiver of the assault rifle and accommodates magazines for shorter cartridges. The conversion unit also includes a forearm and barrel assembly and an upper receiver with a stabilizing rail. A pressure equalizing gas operating system eliminates the need for a buttstock with recoil spring. An operating rod extends forward from the upper receiver and into the forearm enclosure. The operating rod is attached to the bolt of the submachine gun and engaged with a reciprocating gas cylinder that surrounds the barrel.

22 Claims, 15 Drawing Sheets

(56) References Cited

U.S. PATENT DOCUMENTS

| | | | | | |
|---|---|---|---|---|---|
| 4,194,314 | A * | 3/1980 | Foote | F41A 9/40 | 42/16 |
| 4,220,071 | A * | 9/1980 | Seiderman | F41A 11/02 | 42/49.02 |
| 4,297,800 | A * | 11/1981 | Atchisson | F41A 9/71 | 42/49.02 |
| 4,515,064 | A * | 5/1985 | Hohrein | F41A 11/02 | 42/49.02 |
| 5,351,598 | A * | 10/1994 | Schuetz | F41A 5/18 | 42/25 |
| 6,070,352 | A * | 6/2000 | Daigle | F41A 11/02 | 42/49.02 |
| 8,898,946 | B1 * | 12/2014 | Johnson | F41A 9/71 | 42/49.02 |

OTHER PUBLICATIONS

J. Croft, Possible Underground Assault Rifle; the VG 1-5, freedomguide.com, http://freedomguide.blogspot.com/2011/01/possible-underground-assault-rifle-vg-1.html.

* cited by examiner

SUBMACHINE GUN CONVERSION UNIT

CROSS-REFERENCE TO RELATED APPLICATION

This is a continuation-in-part of U.S. patent application Ser. No. 15/221,479 filed Jul. 27, 2016 entitled SUBMACHINE GUN CONVERSION UNIT and which is incorporated herein by reference.

BACKGROUND

The present invention relates to a conversion unit for converting a firearm such as a military assault rifle to a submachine gun. The exemplary conversion unit is described herein with respect to use with a lower receiver for assault rifles in the AR family including the 5.56 mm M16 and 7.62 AR-10 and AR-308, and converting such rifles to submachine guns capable of firing pistol-sized cartridges such as 9 mm, or other cartridges that are shorter than cartridges for which the rifle was designed.

Magazines for 9 mm or similar cartridges are typically shorter front-to-back and of a different width than customary AR magazines for 5.56 and 7.62 cartridges. Prior art adapting the AR style lower receiver to receive and retain such magazines include U.S. Pat. No. 6,070,352 and FIG. 3 therein.

Submachine guns are usually more compact than AR style rifles. Shorter weapons can be more effective in tight spaces such as rooms, stairwells, and other close combat environments where increased rate of fire compensates for less accuracy. Shorter weapons, such as Uzi or HK MP5 submachine guns, are often preferred in these situations, whereas the AR style rifles typically have longer barrel, and a butt stock to accommodate a recoil spring and buffer are less advantageous.

Military weapons must work reliably under a variety of conditions, often adverse. Sometimes only substandard ammunition is available. Variations in combustion gas pressures resulting from substandard ammunition can affect gas operating systems. Tight tolerances for moving parts, such as the bolt within the upper receiver can lead to jamming or other malfunctions. Thus the tolerances in automatic weapons are often generous enough to provide for proper irrigation of debris. However, generous tolerances permit off-axis movement of parts, such as the bolt, increasing wear of any bearing surfaces. Such wear leads to even greater tolerances and further wear. Converting an AR, which typically has an aluminum upper receiver containing a steel bolt, to a submachine with a higher cyclic rate exacerbates the problem. A higher cyclic rate creates more wear and more debris which in turn increases off-axis movement of the bolt within the upper receiver housing. Such movement at a high cyclic rate abrades the softer aluminum, or other softer materials, of the upper receiver housing.

Preferably the conversion unit installs on an AR lower receiver with no tools or extra parts such as a magazine well adaptor.

A conversion unit should be simple and with few variables and few components to enable an operator familiar with an AR to convert between assault rifle and submachine gun with speed and efficiency, and effectively operate both weapons.

SUMMARY

Rather than adapting an AR lower receiver magazine chamber to receive smaller magazines as shown in the prior art, the preferred embodiment of the present submachine gun conversion unit provides a separate magazine well which fits within the magazine chamber of the lower receiver.

Another embodiment of the conversion unit comprises a magazine well integral with or rigidly interconnected to a rear barrel mount to form a rigid central assembly.

Another embodiment of the conversion unit comprises an upper receiver including features such as stabilizing rails and hardened wear surfaces to reduce wear and discourage non-axial movement of the bolt.

In a further embodiment, the conversion unit comprises a pressure-equalizing gas operating system including a moveable gas cylinder engaged with a bolt and operating rod assembly which is shielded within a forearm cover and upper receiver housing.

A further embodiment of the conversion unit comprises a charging handle that can remove the bolt and operating rod assembly.

DETAILED DESCRIPTION OF PREFERRED EMBODIMENT

Referring to FIGS. 1-4 a submachine gun conversion unit 10, is shown in relation to a prior art AR type lower receiver 12. The prior art lower receiver 12, shown here without the handgrip, trigger and firing mechanism, is a commonly used platform for military rifles. Millions of weapons having AR style lower receivers are distributed widely throughout the world, and millions of soldiers have been trained in the use of such weapons. Operation of the exemplary submachine gun described herein will be very familiar to those trained on the weapons mentioned above.

Figure 3:
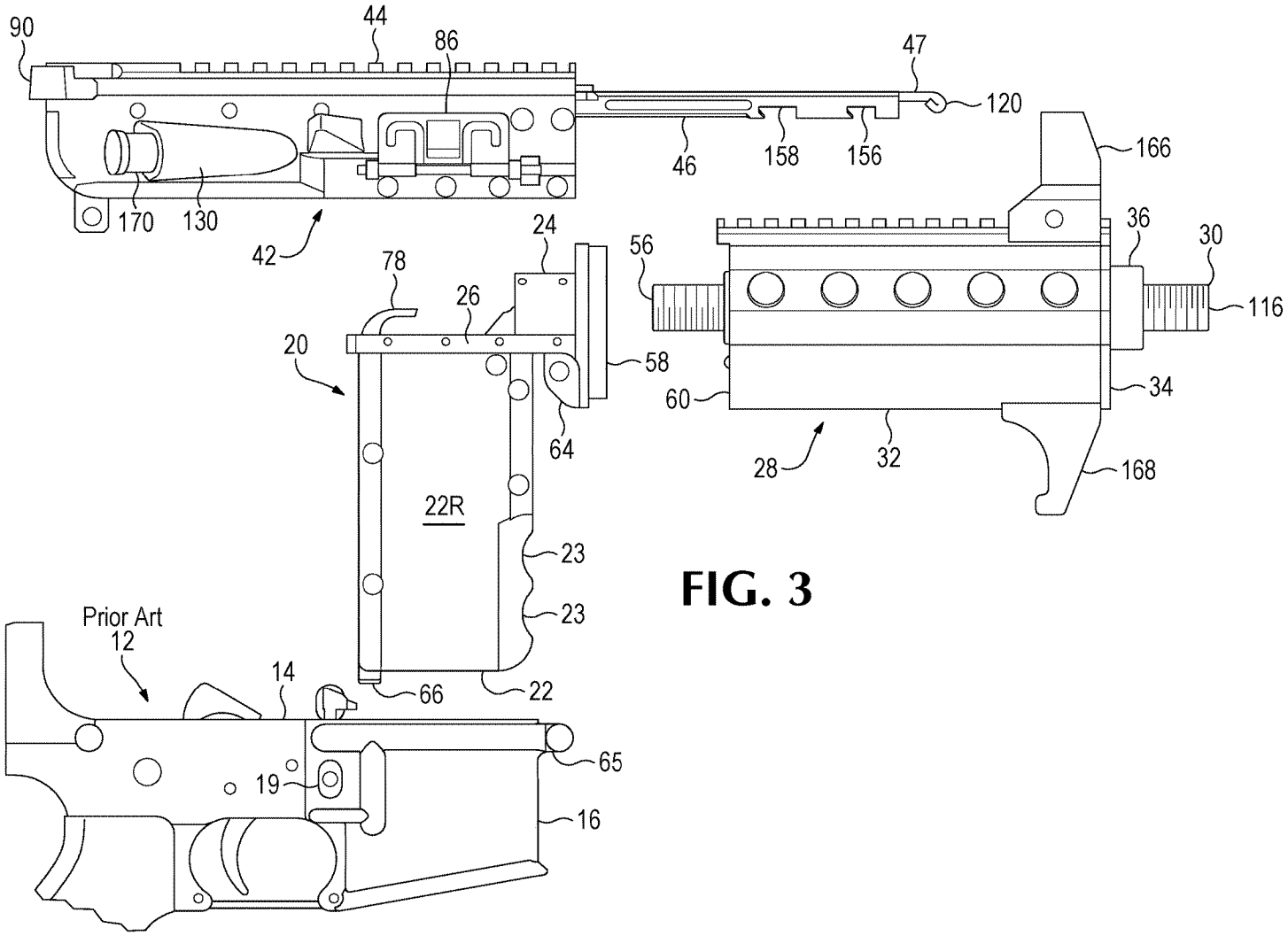
FIG. 3 is a right side elevation view of the disassembled conversion unit of FIG. 1.
Figure 4:
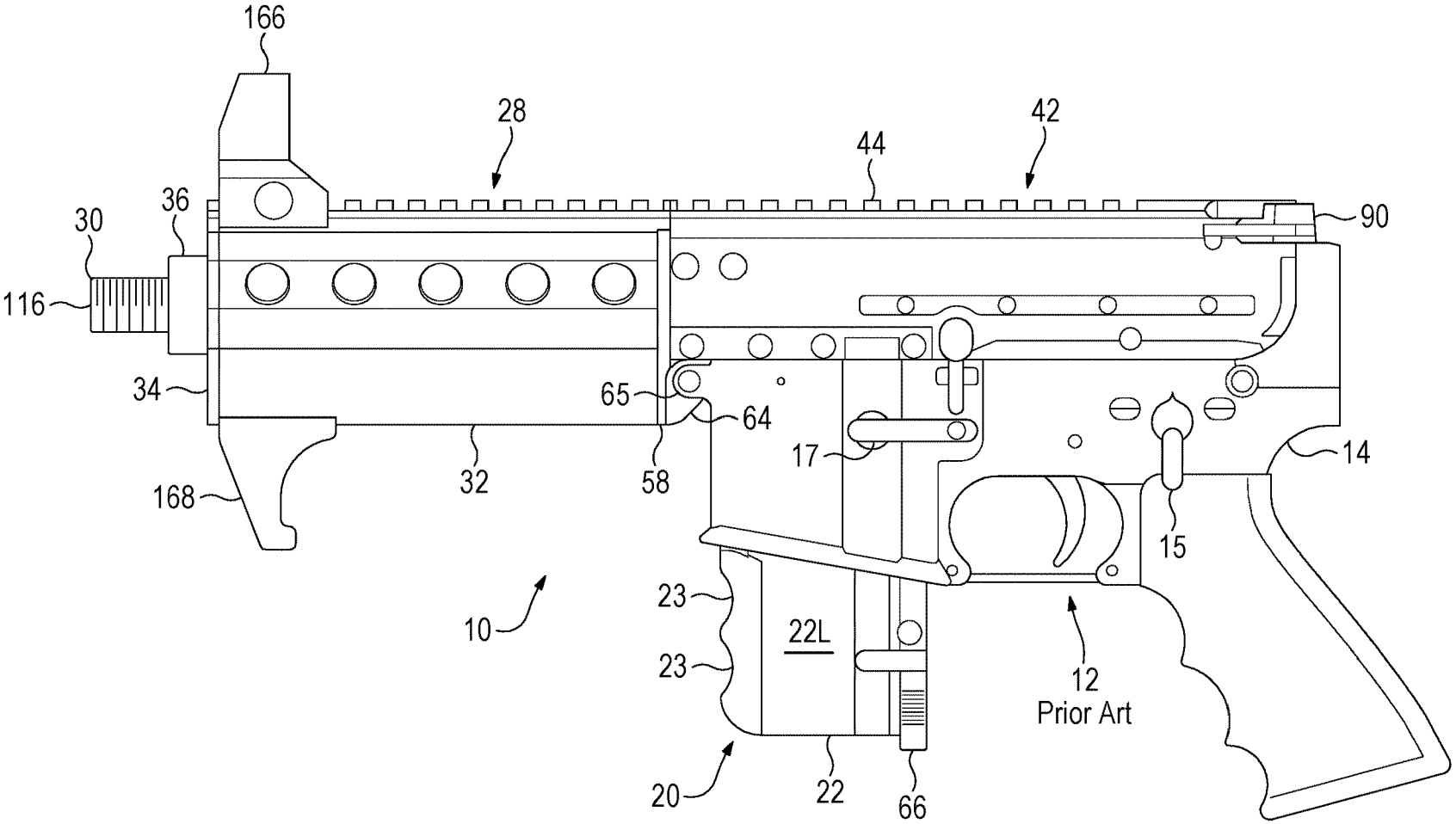
FIG. 4 is a left side elevation view of the assembled conversion unit of FIG. 2.

The prior art AR style lower receiver 12 includes a receiver frame 14 defining a lower receiver magazine chamber 16 for accepting a magazine (not shown) of the type and size typically used with AR platform rifles. The receiver frame 14 includes a transverse cylindrical bore 18 extending from the right side of the receiver frame 14 to the left side. A spring biased shaft, not shown, is arranged in a transverse bore. A finger button 19 shown in FIG. 3 is located on the right end of the shaft, and an operable magazine catch 17 shown in FIG. 4 is located at the left end of the shaft. The magazine catch 17 further includes an inwardly directed end (not shown) which is sized and shaped to be received within a corresponding catch opening in the left side wall of the magazine chamber 16. The magazine catch 17 is normally biased to a closed position, i.e., drawn up against the left outer surface of the magazine chamber 16 by a spring not shown, with the inwardly directed end fully received in the catch opening. The inwardly directed end extends sufficiently through the left side wall of the magazine chamber 16, to engage a magazine within the chamber, or as will be discussed below, the magazine well 22 of the present invention and a magazine contained therein. When a magazine is in the magazine chamber 16, pressing on the finger button 19 on the right side of the lower receiver frame 14 moves the associated shaft to the left, overcoming the spring bias of the catch mechanism 17 and causes the inwardly directed end of the catch mechanism to withdraw from the lower receiver magazine chamber 16 releasing the magazine. This prior art magazine catch arrangement is standard for AR style rifles.

The magazine chamber 16 of the prior art AR lower receiver 12 shown in FIG. 4 may be sized to receive, for example, standard magazines for 5.56 mm or 7.62 mm cartridges used by military organizations throughout the world. The safety and fire selection switch 15 is located in its customary place on the left side of the lower receiver 12 as shown in FIG. 4 and the finger button 19 for operating the magazine catch mechanism 17 is located in the usual spot on the right side of the lower receiver 12 just in front of and above the trigger as shown in FIG. 3.

As shown in FIGS. 1-4, the exemplary conversion unit 10 includes: a central assembly 20 including a magazine well 22 and rear barrel mount 24; a forearm and barrel assembly 28 including a barrel 30, forearm cover 32, forearm face plate 34, barrel locking nut 36, recoil spring 38, and spring guide 40; and an upper receiver 42 including an upper receiver housing 44, a charging handle 90, a stabilizing rail 134 and bolt 82 with connected operating rod 46 and gas cylinder retaining spring 47.

Figure 5:
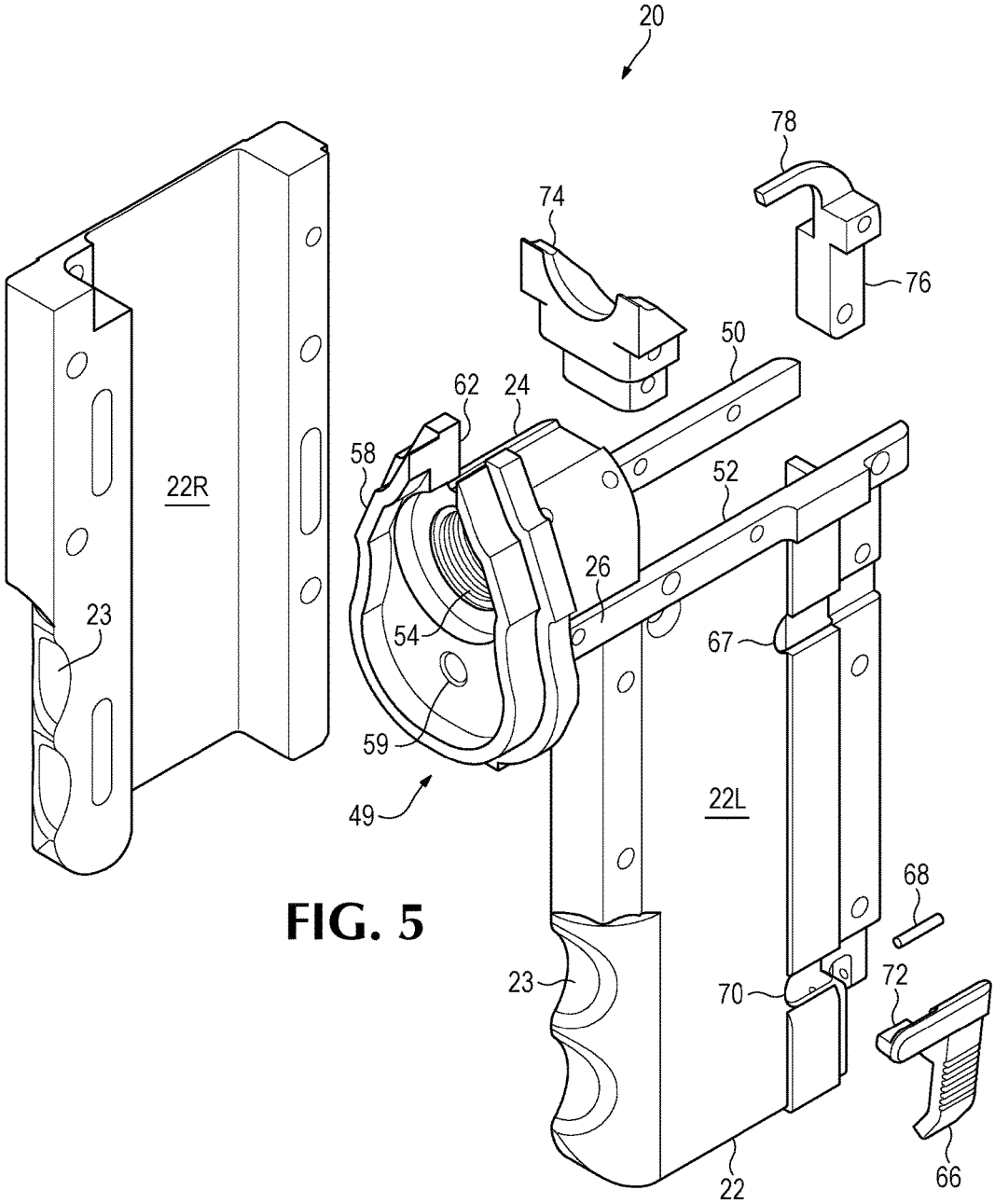
FIG. 5 is a left side perspective view of a disassembled central assembly of the exemplary conversion unit.

The exemplary embodiment of the central assembly 20 shown in FIGS. 5-9 includes a rear barrel mount 24, the left side 22L of the magazine well 22, and connecting bracket 26, all integrally formed together as an integral mono block 49 from a single body of substantially uniform material such as steel or aluminum by, for example, milling, casting, forming or printing. However, in alternate embodiments, the magazine well 22 and rear barrel mount 24 can be separate pieces, which when assembled make up a rigid central assembly 20. Alternatively, the integral mono block central assembly may be made of other metals or non-metallic materials, such as polymers, plastics or carbon fiber, or combinations thereof. The rigid character of the central assembly 20 helps prevent misalignment of the rear barrel mount with respect to the magazine, which can cause ammunition feeding problems exacerbated by the higher cyclic rate of a submachine gun. As shown in FIG. 5, in addition to the mono block 49 components, in the exemplary embodiment the central assembly 20 includes a right side magazine well cover 22R to define a well cavity 51. The right and left arms 50 and 52 respectively of bracket 26 are rigidly connected to or formed integrally with the left side 22L of magazine well 22 and the rear barrel mount 24. Although the exemplary embodiment is described as having an interconnecting bracket 26, an alternative embodiment may not include such a bracket, but still having the well 22 rigidly connected to the rear barrel mount 24.

Figure 1:
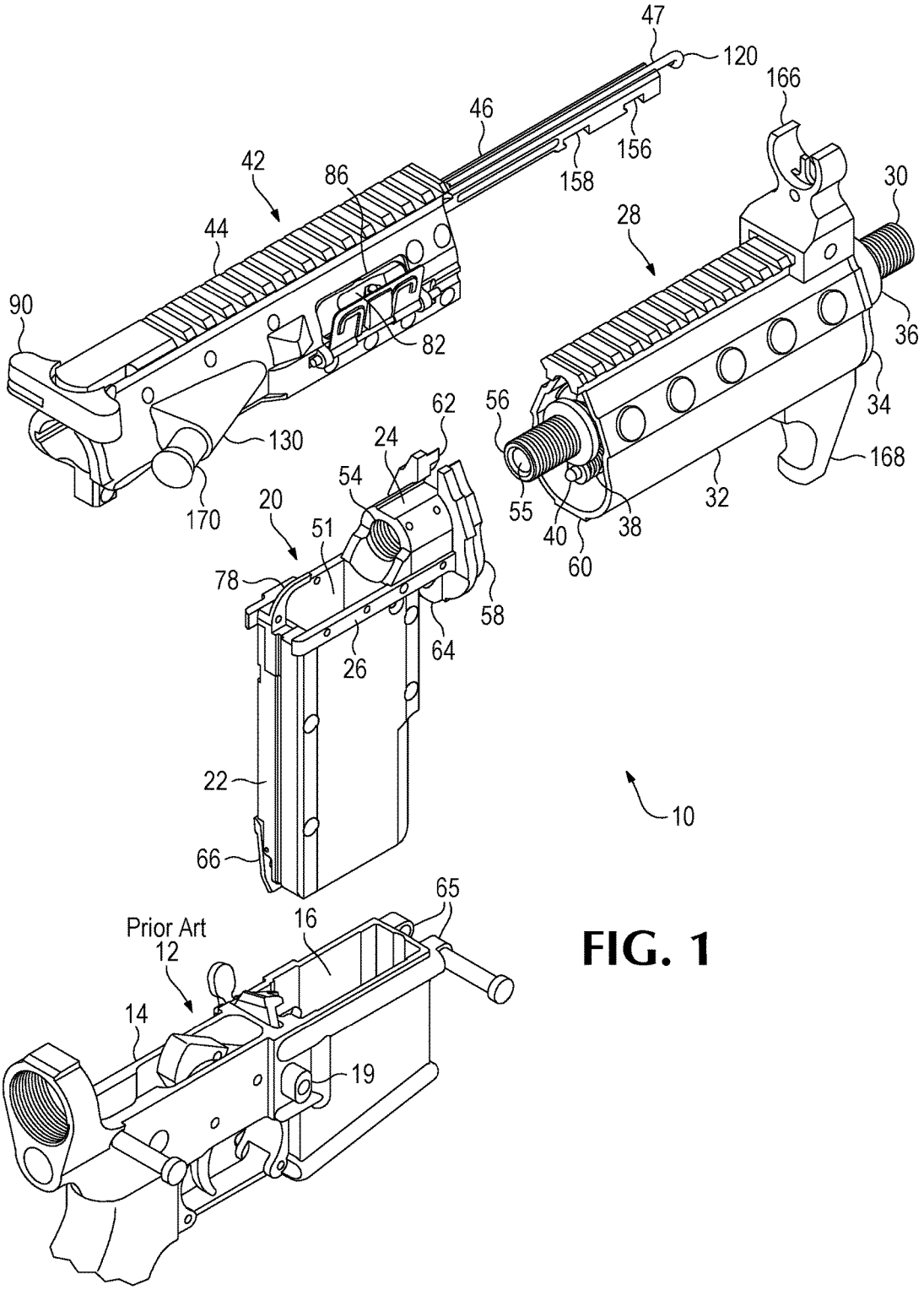
FIG. 1 is a right side perspective view of a disassembled embodiment of the exemplary conversion unit shown in association with a prior art AR style lower receiver.
Figure 14:
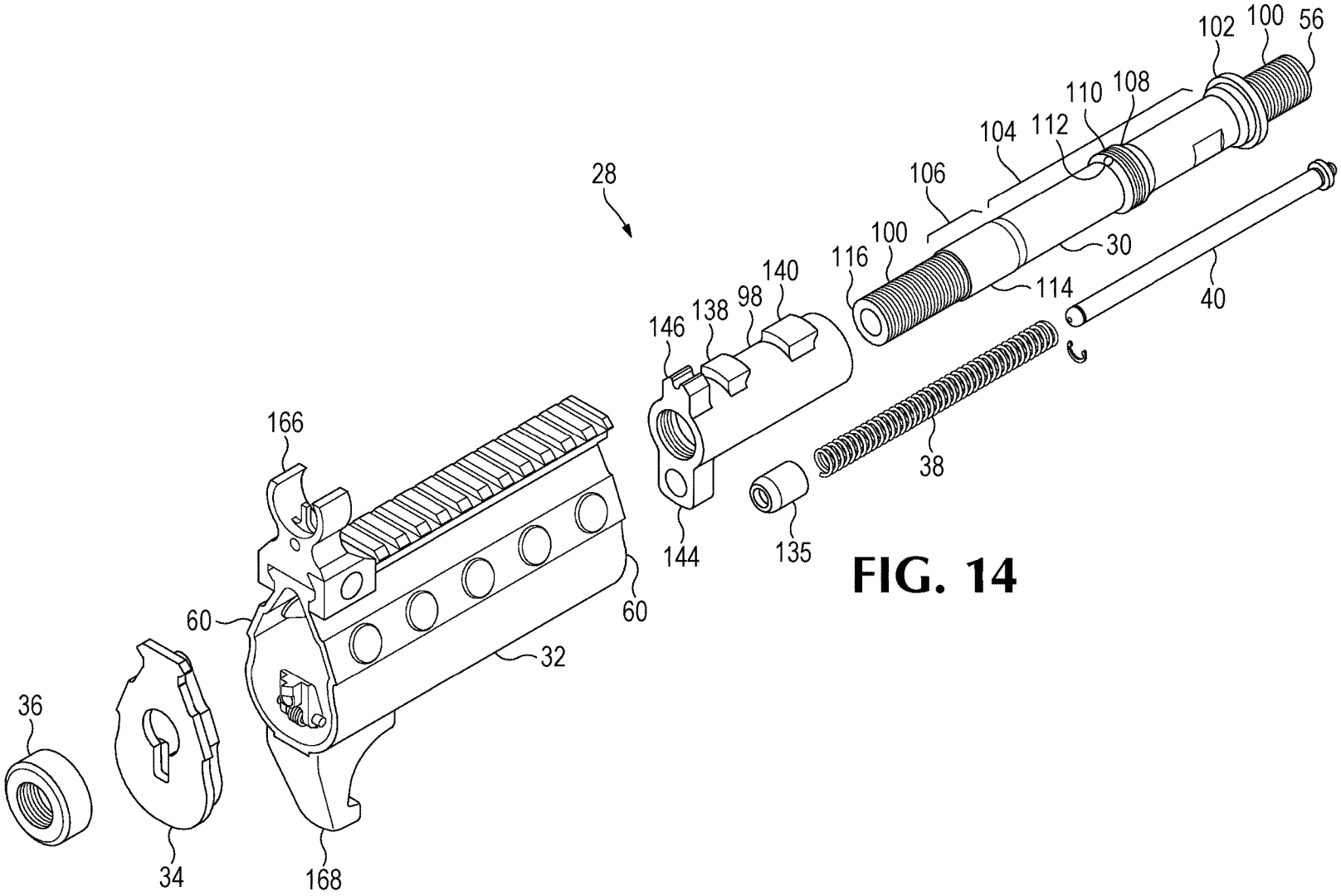
FIG. 14 is a left side perspective view of the disassembled forearm and barrel assembly.
Figure 15:
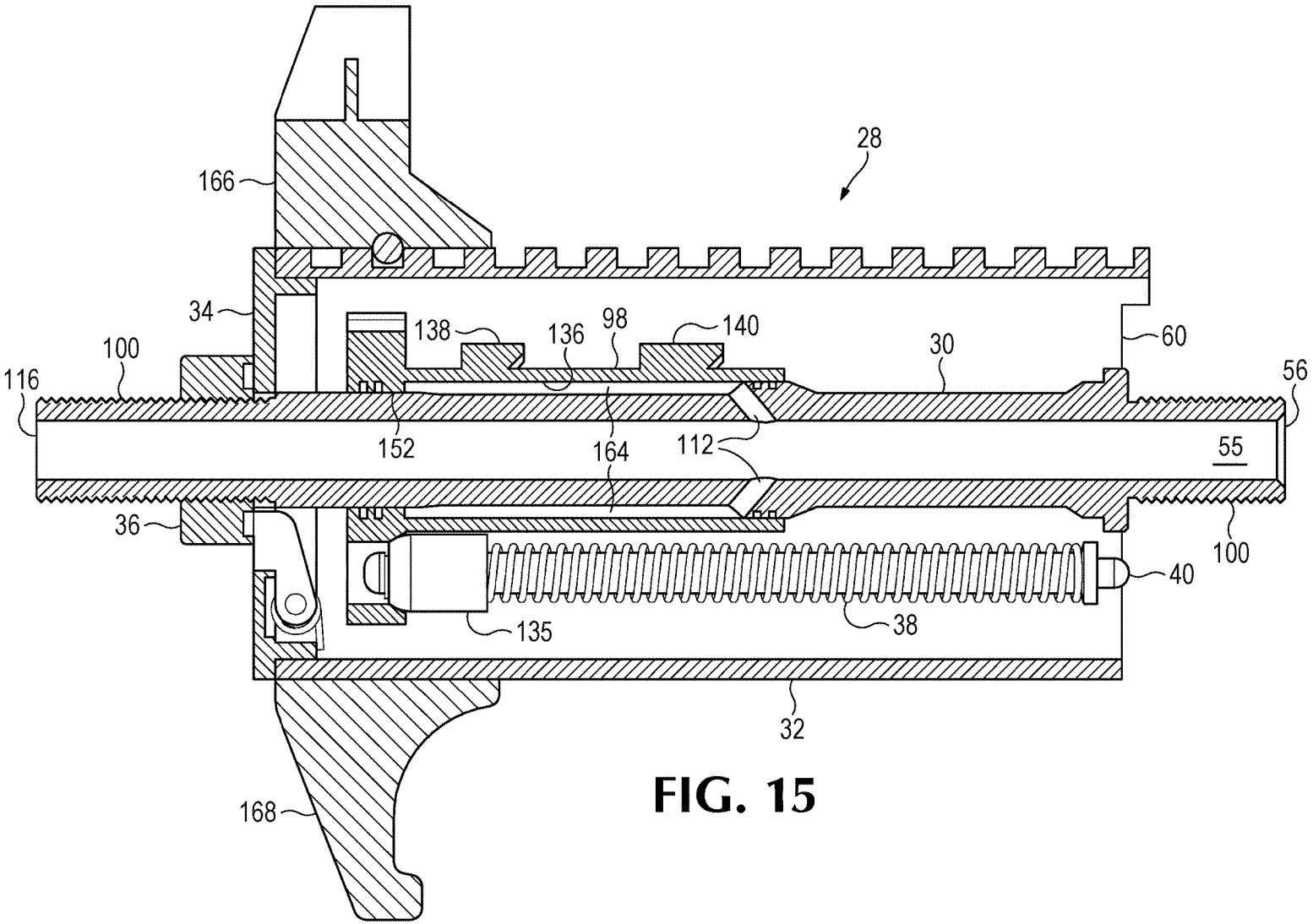
FIG. 15 is a left side cut-away view of the forearm and barrel assembly shown in FIG. 14 with the barrel, forearm cover and gas cylinder in cross section.

The rear barrel mount 24 includes a threaded barrel-receiving portion 54 for engagement with a threaded breech end 56 of the barrel 30 shown in FIGS. 1 and 3, and a forearm mounting frame 58 for mating with the rearward end 60 of the forearm cover 32 shown in FIGS. 1, 14 and 15. The breech end 56 of barrel 30 defines the firing chamber 55. The top of forearm mounting frame 58 includes slot 62 for permitting the operating rod 46 which is shielded within the forearm cover 32 above the barrel 30 to extend into the upper receiver 42. As will be explained below, the forearm cover 32 and slot 62 therein permit the operating rod 46 and gas cylinder 98 to reciprocate wholly shielded within the forearm assembly 28 and upper receiver housing 44. The rear barrel mount 24 also includes an integral lug 64 with an aperture formed therein depending below the barrel receiving portion 54 to serve as a connection point with the AR lower receiver as shown in FIGS. 1, 3 and 4. The forearm mounting frame 58 also includes an abutment dimple 59 for receiving the rearward end of the recoil spring guide 40 and cap 135.

Referring to FIGS. 1 and 3, when the magazine well 22 of the central assembly 20 is inserted downwardly into the magazine chamber 16 of the lower receiver 12, the lug 64 is received between two spaced apart ears 65 on the forward portion of the lower receiver frame 14. Apertures in the ears 65 match up with the aperture in the lug 64 to receive a common pin (not shown) to attach the central assembly 20 to the lower receiver 12. This pin, and another pin connecting the upper receiver 42 to the AR lower receiver 12 are devised to be withdrawn sufficiently to release the lower receiver 12 from the conversion unit 10 without tools, but include a feature which retains the pins in attachment with the lower receiver 12 so as to not lose the pins when the conversion unit 10 is mounted upon, or dismounted from, the lower receiver 12. Also, as explained below, the magazine well 22 is adapted to engage with the standard AR magazine catch mechanism 17 to releasably attach the well 22 to the lower receiver 12. These three points of attachment between the lower receiver 12 and the conversion unit 10, can be quickly manipulated to engage or disengage the lower receiver and conversion unit without tools.

Referring to FIGS. 5-8, the left side 22L of magazine well 22 includes an upper slot 67. As discussed above, a standard AR receiver frame 14 includes a magazine catch 17 on the left side of the receiver frame 14 as shown in FIG. 4. When the well 22 is seated in the lower receiver 12 magazine chamber 16, the upper slot 67 in the left side cover 22L of the magazine well 22 aligns with the magazine catch 17 on the magazine chamber 16 and the inwardly directed end of the catch mechanism 17 extends through the slot 67 in the left side cover 22L to retain the well 22 in the magazine chamber 16. However, pressing the magazine catch button 19 on the right side of the lower receiver 12 disengages the magazine catch 17 from the magazine well 22 and permits the well 22 to be withdrawn from the magazine chamber 16. Aside from the close fit of the well 22 within the magazine chamber 16, the cooperation of the upper slot 67 in well left cover 22L and the magazine catch 17 of the lower receiver 12 is the only direct attachment between the well 22 and the lower receiver 12.

As shown in FIGS. 1-8, the well 22 has an upper portion that is closely received within the magazine chamber 16 of the lower receiver 12. The well 22 also has a lower portion that extends below the magazine chamber 16. The lower portion of the well 22 has finger grip indentations 23. These finger grip features 23 provide a convenient hand-hold for the operator. As explained above, a portion of the magazine well 22 is preferably integrally formed from a single body of substantially uniform material with the rear barrel mount 24, or is otherwise part of the same rigid assembly, thus there is a direct connection between the well 22 and the barrel 30 through the rear barrel mount 24, and providing positive control of the weapon and smooth feeding of ammunition to the firing chamber 55.

Figure 6:
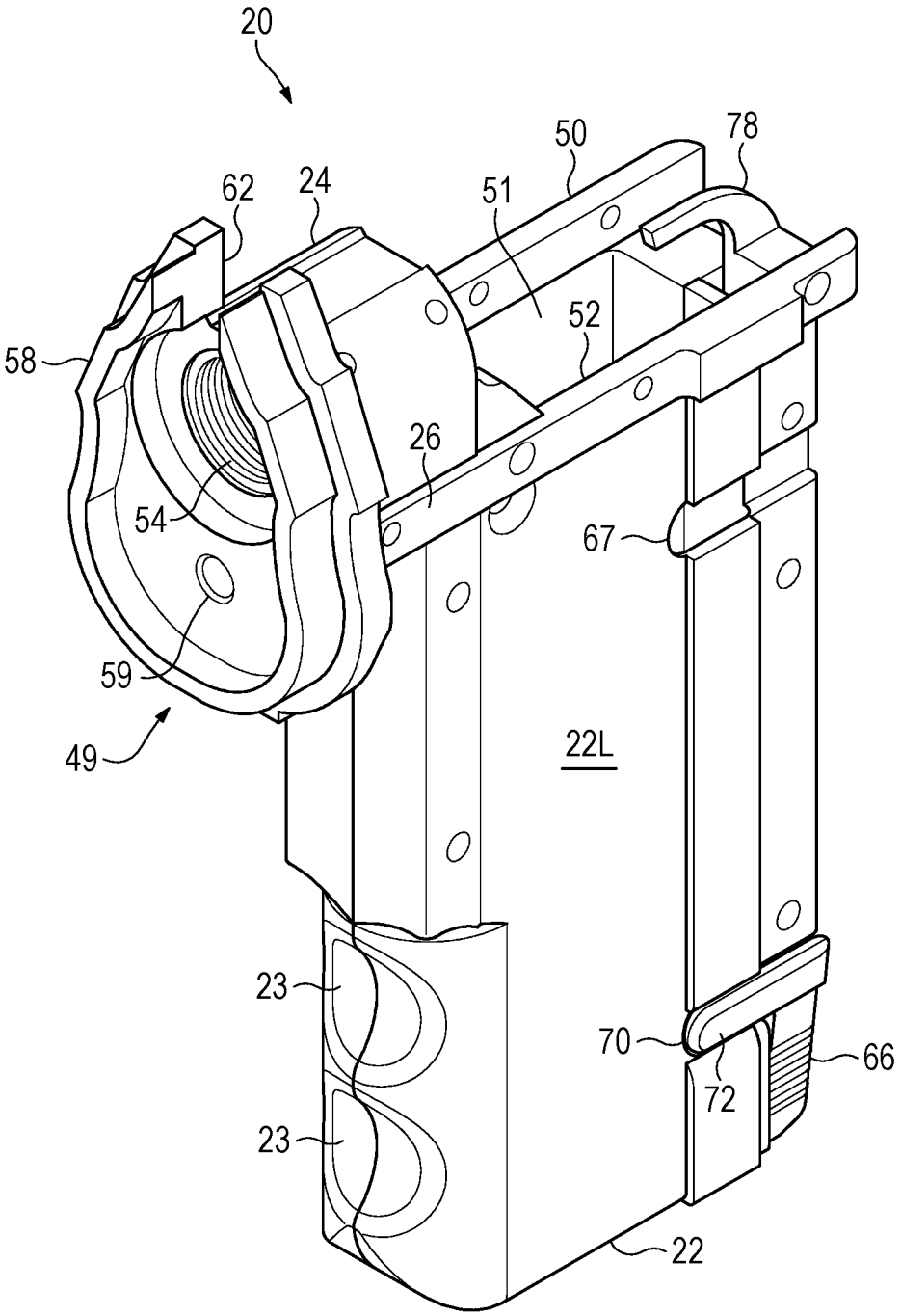
FIG. 6 is a left side perspective view of the assembled central assembly of FIG. 5.

Referring to FIGS. 4-6, the left side cover 22L of the well 22 also includes an operable magazine latch 66 in the lower portion thereof for releasably engaging a magazine of shorter cartridges received in the well 22. The magazine latch 66 on the lower well 22 is separate and independent from the magazine catch 17 on the prior art lower receiver 12. The left side cover 22L of well 22 includes latch aperture 70 which receives a protruding engagement stud 72 on the magazine latch 66 for engaging a magazine within the well 22. The latch 66 pivots about a pin 68 and is biased by a spring, not shown, toward a closed position with the engagement stud 72 extending through latch aperture 70 and engaging a corresponding aperture in the magazine. Pressing on the lower portion of magazine latch 66 overcomes the spring force and causes the latch 66 to pivot about the pin 68 and withdraw the stud 72 from engagement with a magazine in the magazine well 22.

Figure 13:
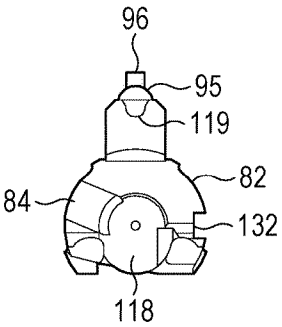
FIG. 13 is front elevation view of the bolt and operating rod assembly of FIG. 11.

There are two prevalent types of submachine gun 9 mm magazines. Referring to FIG. 13 of U.S. Pat. No. 6,070,352, the Colt style 9 mm magazine, designated as 111 in FIG. 13 of the '352 patent, has an aperture positioned in the upper left portion of the magazine in position to cooperate with the prior art magazine catch 17 typical of an AR lower receiver 22. This AR magazine catch is designated by number 66 in FIG. 13 of U.S. Pat. No. 6,070,352 and by number 17 in FIG. 4 of this application. The exemplary embodiment of the conversion unit 10 described herein accepts a Colt style 9 mm magazine because the catch mechanism 17 on the AR lower receiver extends through the slot 67 in the left side wall 22L of well 22 and engages a Colt style magazine within the well 22. A second type of 9 mm magazine, compatible with weapons such as the Uzi sub-machine gun and HK MP5 has a latch aperture located on the lower left side of the magazine in a location that would be below the magazine chamber 16 of a prior art AR lower receiver 12. Therefore, the adaptor disclosed in U.S. Pat. No. 6,070,352 is not compatible with Uzi style 9 mm magazines, whereas the magazine well 22 described herein is compatible with both types of 9 mm magazines. Although the conversion unit 10 has been described with respect to use with two types of 9 mm magazines, it can also be adapted for use with certain pistol magazines and other magazines for shorter cartridges.

In an alternative embodiment, the magazine well 22 may be used alone as an adapter, not part of a central assembly 20 as described above, to enable an AR lower receiver 12, for example, to accept and retain magazines for shorter cartridges. As an adaptor, the well 22 would be retained in the lower receiver 12 magazine chamber 16 by the cooperation of the magazine catch 17 on the lower receiver 12 and the slot 67 in the left wall 22L of the well 22.

Nor is the magazine well 22 of the present invention limited to use with an AR style lower receiver. It can also be suitably sized and shaped for use with other prior art lower receivers that have magazine chambers.

Figure 7:
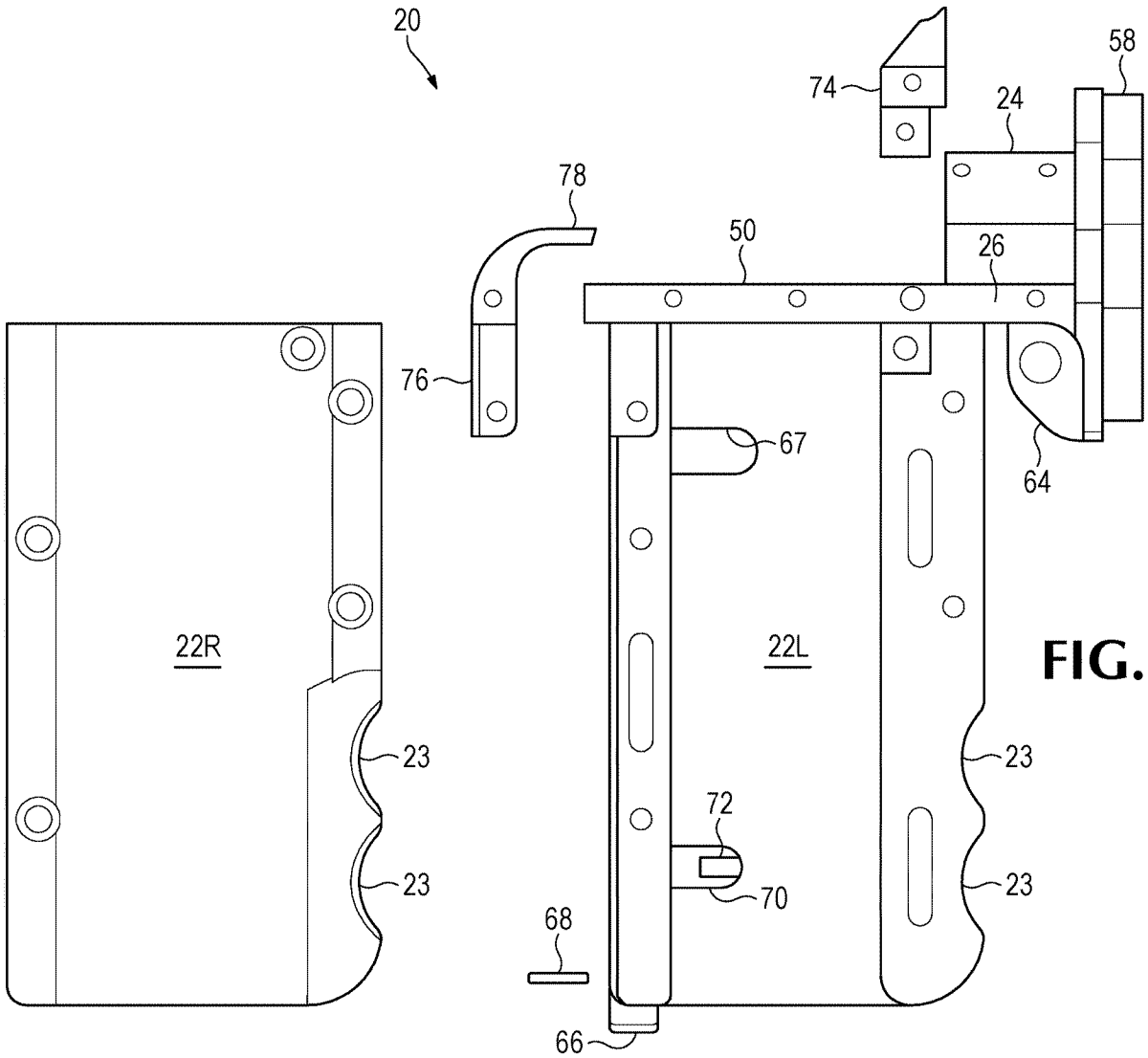
FIG. 7 is a right side elevation view of the disassembled central assembly of claim 5.
Figure 8:
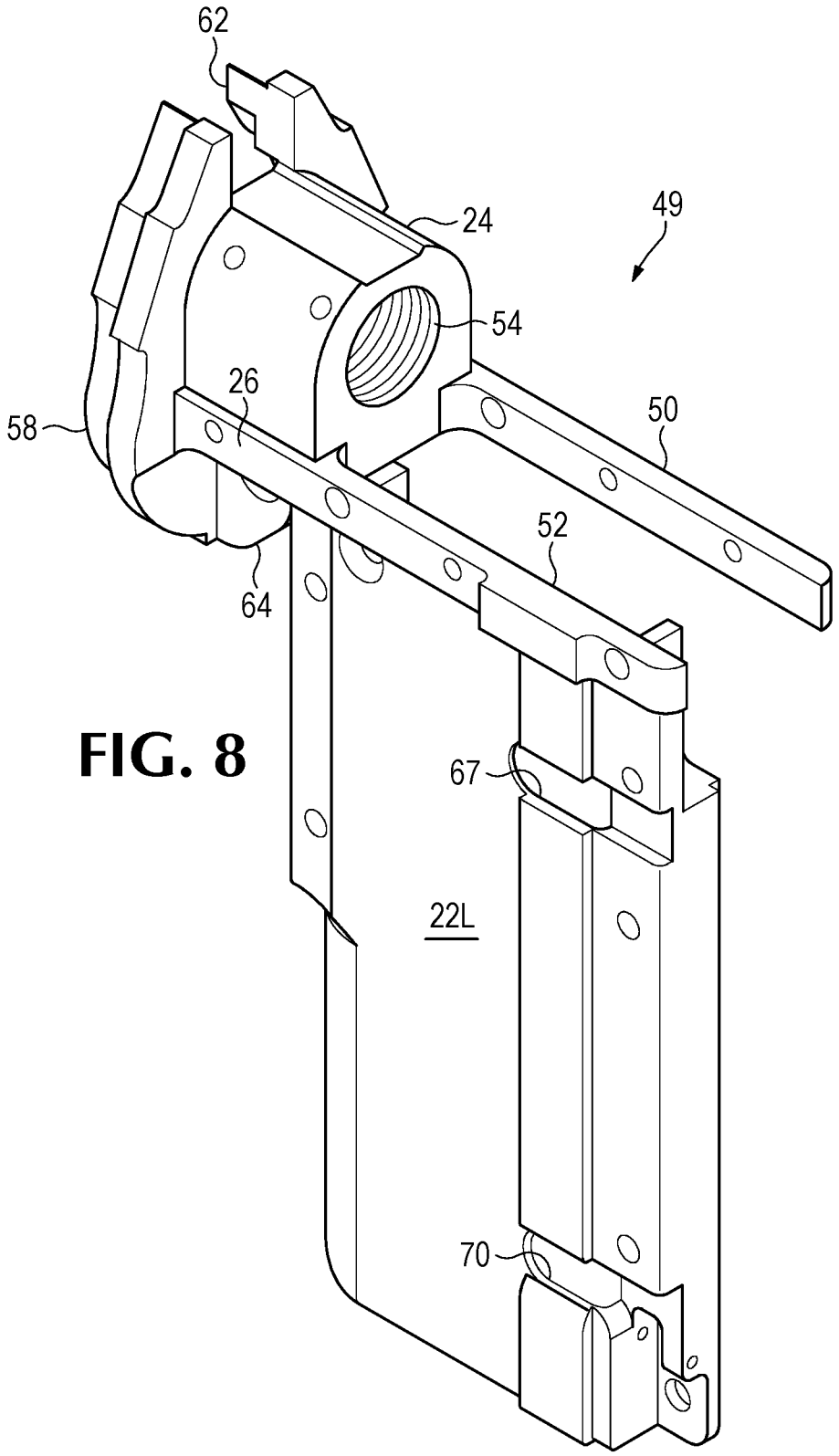
FIGS. 8 and 9 are left and right perspective views of a "mono block" central assembly of FIG. 5.
Figure 9:
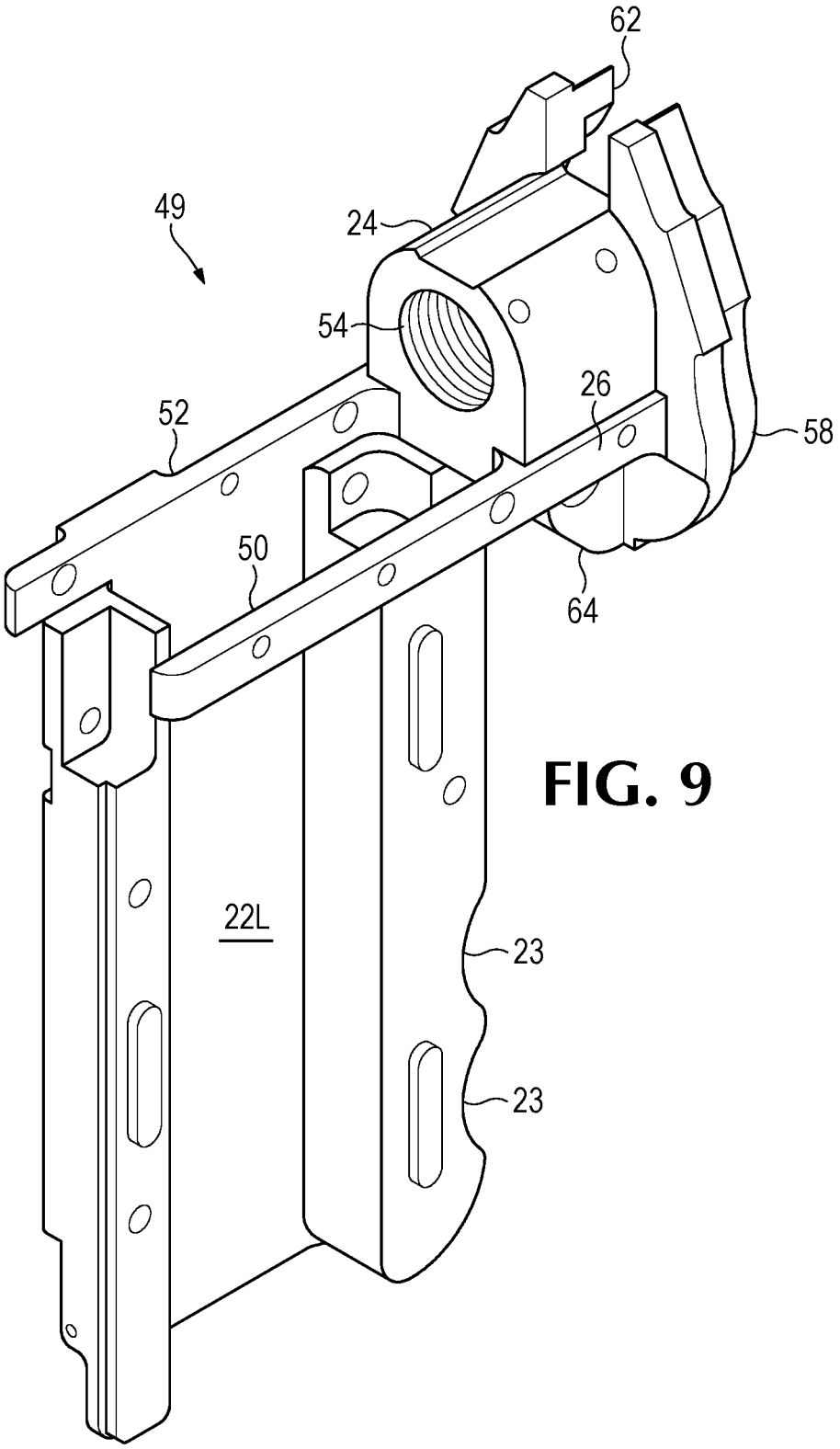

As best seen in FIGS. 5 and 7, the exemplary central assembly 20 accommodates a feed ramp 74 for assisting cartridges to move smoothly from a magazine contained in well 22 into the firing chamber 55. In the exemplary embodiment, the feed ramp 74 is fastened to the right and left arms 50 and 52 of the bracket 26.

The central assembly 20 also accommodates an ejector 76 fastened to the left arm 52 of bracket 26 toward the rear of well 22. The ejector 76 includes an upstanding finger 78 positioned above the left rear portion of the well. The operation of the ejector 76 will be explained below.

Referring to the FIGS. 1-4 and 10, the exemplary conversion unit 10 includes an upper receiver 42 having an upper receiver housing 44, a bolt 82, an operating rod 46 rigidly connected to the bolt, a stabilizing rail 134 and a charging handle 90. The top surface of the receiver housing 44 includes a Picatinny rail 43 having transverse rails and slots to facilitate mounting of sights, optics and other accessories.

Figure 10:
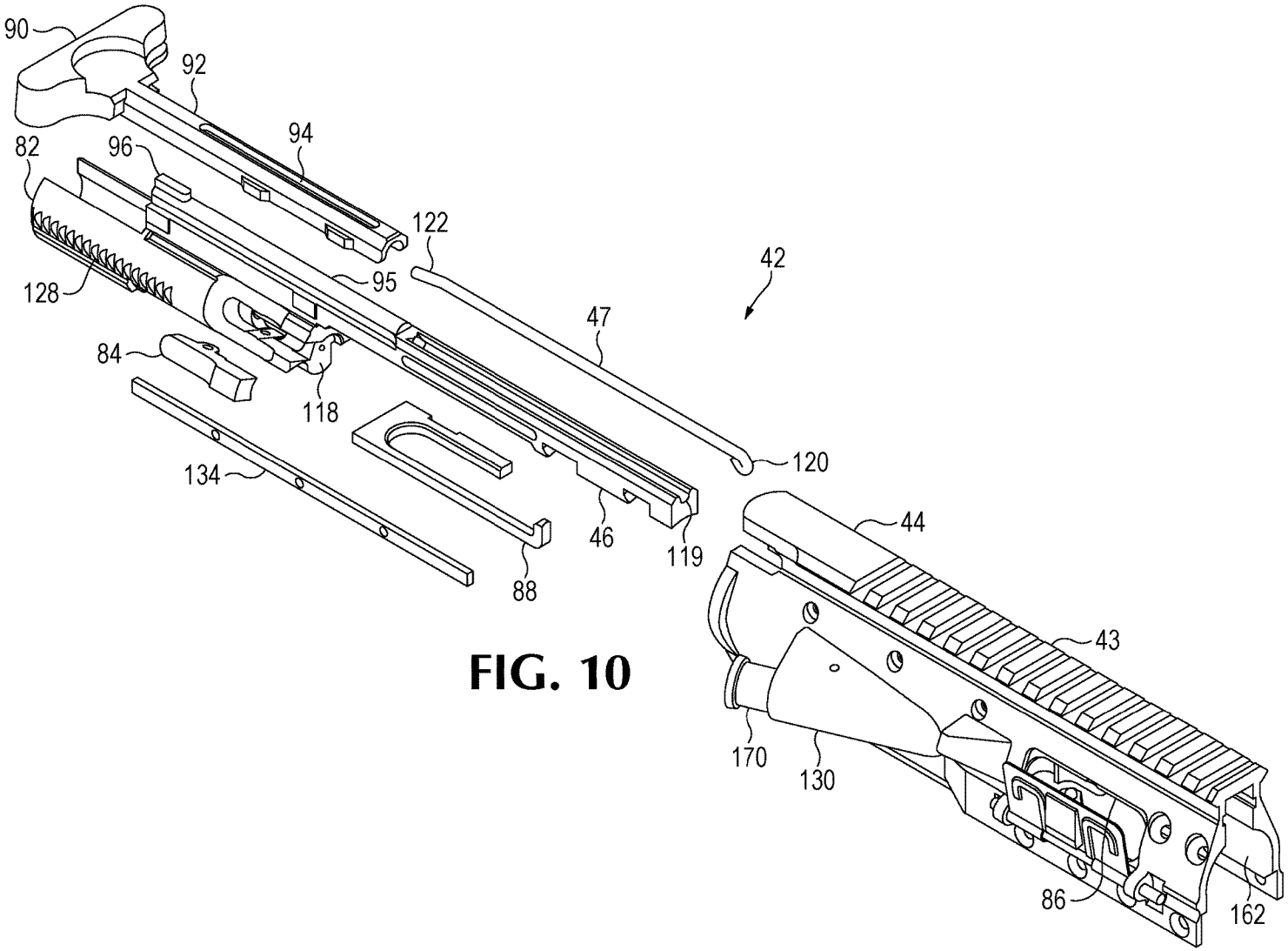
FIG. 10 is a right side perspective view of a disassembled upper receiver of the conversion unit shown in FIG. 1.

It is important that the connection between the operating rod 46 and the bolt 82 be secure. Preferably the bolt 82 and operating rod 16 are welded together or integrally formed from a single body of substantially uniform material. Alternative means of secure rigid connection such as pins, screws and keys are also acceptable. As shown in FIGS. 10 and 13, the bolt 82 includes an extractor 84 located closely adjacent to the right side of bolt face 118 for capturing the right rim of a cartridge and extracting the spent cartridge from the chamber 55 when the bolt 82 moves rearwardly away from the breech 56 during the recoil process. As the spent cartridge is carried back by the bolt 82, the left rim of the shell hits the ejector finger 78 which tips the spent shell from the grasp of the extractor 84 and out the ejection port 86 located on the right side of the upper receiver housing 44. The upper receiver 42 also includes a sear plate 88 to accommodate fully automatic operation.

Figure 2:
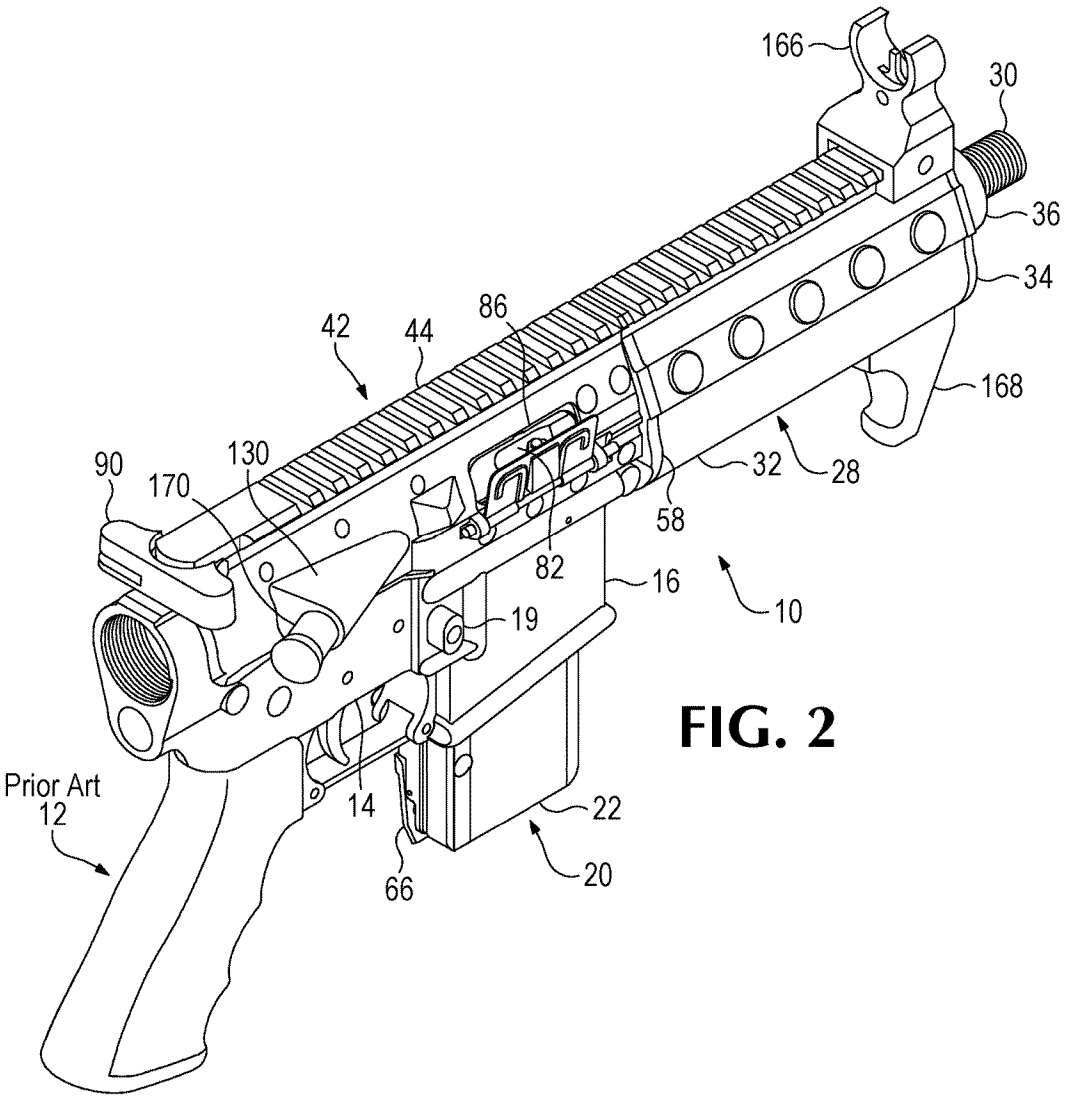
FIG. 2 is a right side perspective view of the assembled conversion unit of FIG. 1 mounted upon the prior art AR lower receiver.

As shown in FIGS. 1, 2 and 10, the upper receiver 42 also includes a charging handle 90 situated in the upper rear portion of the housing 44. The charging handle includes an elongate tongue 92. As shown in FIG. 10, in cross-section the tongue 92 is arched and has an elongate slot 94 through the roof of the arch. The arched tongue 92 fits over an elongate ridge 95 on the top of operating rod 46. The ridge 95 includes an upstanding post 96 on the top of the ridge 95. When the charging handle 90 is assembled with the operating rod 46 and bolt 82, the post 96 on the operating rod 46 extends upwardly into the slot 94 in the tongue 92 of the charging handle 90. The slot 94 enables the bolt 82 and operating rod 46 to move substantially axially within the upper housing 44 during normal firing operation without disturbing the charging handle 90. However, when the charging handle 90 is drawn back, the slot 94 on the tongue 92 catches the post 96 and draws the operating rod 46 and bolt 82 rearwardly. This arrangement has two purposes. First, it enables the operator to manually retract the bolt against the force of the recoil spring 38 shown in FIGS. 1, 14 and 15. When the bolt is retracted, a portion of the upper receiver 42 above the magazine well 22 and rearwardly of the breech 56 is open to receive a live cartridge biased upwardly from a magazine situated in the magazine well 22. Pushing the charging handle 90 forward assists the recoil spring 38 to force the bolt 82 securely against the breech 56 seating the cartridge in the firing chamber 55. Further operation of the charging handle 90 relates to interaction of the bolt 82 and operating rod 46 with components in the forearm and barrel assembly 28 during disassembly and will be described below.

Figure 11:
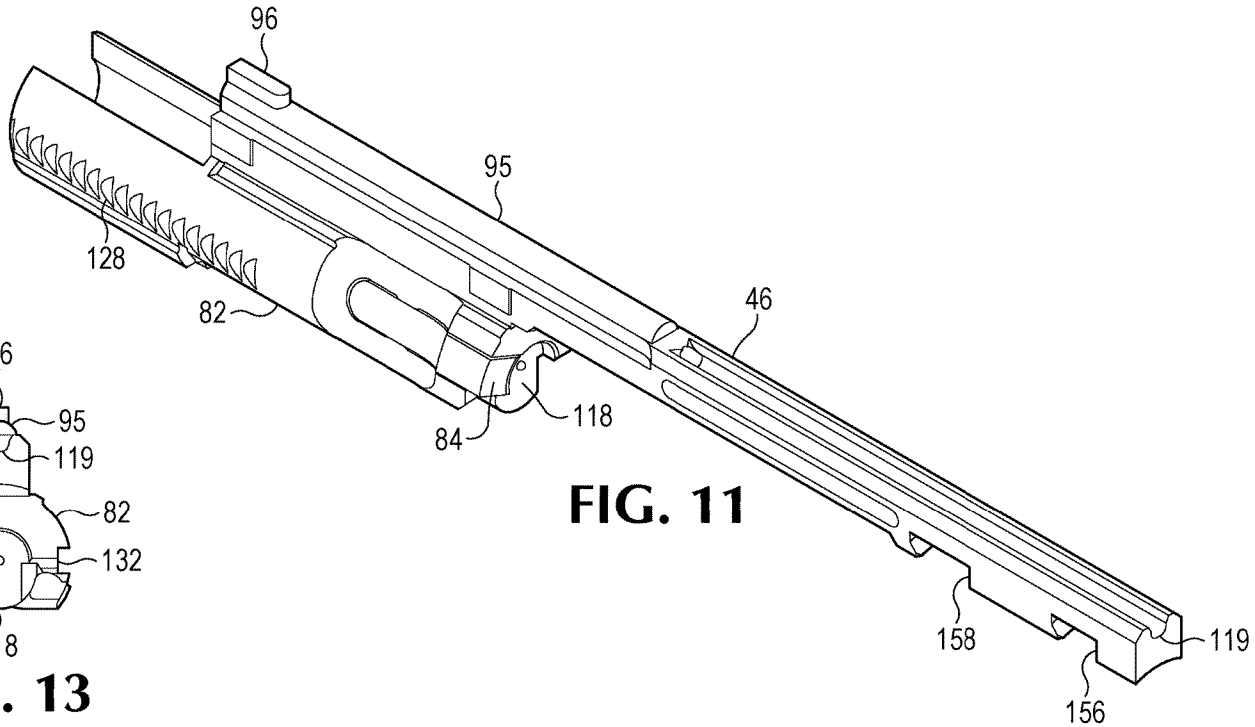
FIG. 11 is a right side perspective view of the bolt and operating rod assembly of the upper receiver shown in FIG. 10 without the gas cylinder retaining spring.
Figure 12:
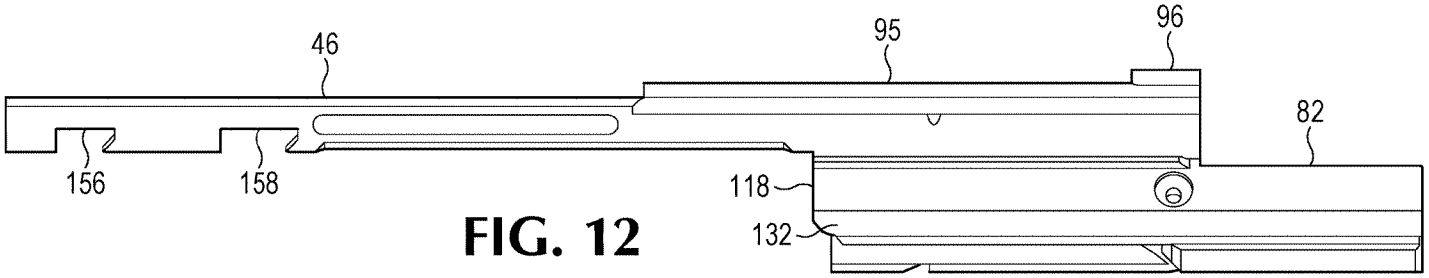
FIG. 12 is a left side elevation view of the bolt and operating rod assembly of FIG. 11.
Figure 18:
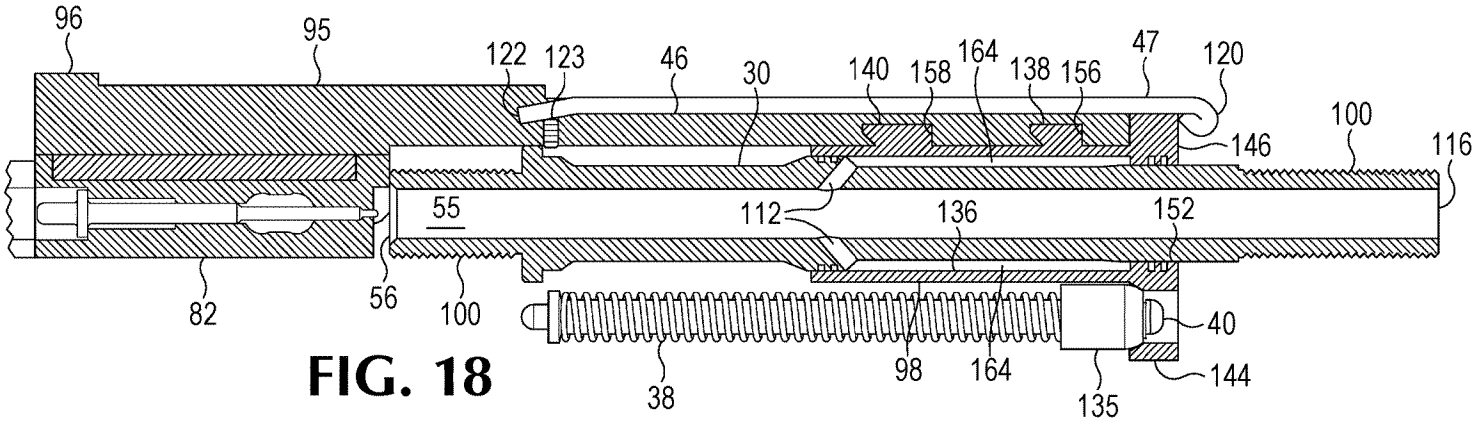
FIG. 18 is a right side partial cross section view of the operating system for the conversion unit including the barrel, gas cylinder, operating rod and bolt in section.

FIGS. 11-13 show the bolt 82 and operating rod 46 in greater detail. The rearward portion of the operating rod 46 includes a base which sits atop the bolt 82. The base includes the aforementioned ridge 95 and post 96. The operating rod 46 includes a long arm extending forward of the bolt face 118. The forward portion of the arm includes a forward seat 156 and a rearward seat 158, the purpose of which will be discussed below. The arm has a groove 119 on the upper surface. As shown in FIGS. 1, 3 and 18, the groove 119 receives an elongate gas cylinder retaining spring 47 with a forward finger 120. The rearward end 122 of the retaining spring 47 is fixedly received in the top of the operating rod 46 by a set screw 123 or other means, but the forward end of spring 47 is free, permitting the forward portion of the spring near the finger 120 to be lifted out of the groove 119 against the resilient force of the spring. As will be described below, the function of the spring 47 and finger 120 is to selectively retain the gas cylinder 98 in engagement with the operating rod 46.

Referring to FIGS. 1, 10 and 11, the right side of bolt 82 includes a series of rearwardly facing serrations 128 which may be engaged by a plunger 170 of a forward assist mechanism positioned in the forward assist tunnel 130 on the upper housing 44. Pushing on the plunger 170 causes it to engage one of the serrations 128 in the bolt 82 and push the bolt forward toward the breech end 56 of the barrel 30 to fully seat a live cartridge in the firing chamber 55. The serrations 128 and forward assist mechanism 130, 170 are part of the prior art.

Referring to FIG. 10, the exemplary embodiment of the upper receiver 42 includes a stabilizing rail 134. When assembled, the rail 134 is attached to the interior left side wall 162 of the upper housing 44 in an orientation parallel to the movement of the bolt 82. Referring to FIGS. 12 and 13, the left side of bolt 82 includes a channel 132 for receiving the rail 134 shown in FIG. 10. The rail 134, typically made of steel or other hard material, helps to limit off-axis movement of the bolt 82 as it cycles within the upper receiver housing 44; reducing wear, which can cause debris, and thereby improving the operation of the firearm. By discouraging movement of the bolt 82 other than coaxial with the barrel 30, the operating system described below needs less force to operate and is more likely to overcome adverse conditions in combat situations. Although the rail 134 is described as being located on the left sidewall 162 of the upper housing 44, a stabilizing rail may be located elsewhere in the housing. One possible location is the interior right sidewall of housing 44. With a stabilizing rail on the right side of the housing 44, the right side of bolt 82 would have a channel, similar to channel 132, to receive a right side stabilizing rail. Such a channel may have to cut through the serrations 128 on bolt 82 while still leaving sufficient rearwardly facing surfaces to cooperate with the forward assist mechanism. In addition to the rail 134, other wear and stabilizing features, or wear surfaces generally, may be employed to reduce debris caused by abrasion and off-axis movement of the bolt.

In the exemplary conversion unit described herein, the bolt 82 and operating rod 46 are primarily supported within the upper receiver 42 by the stabilizing rail 134. As will be described below, when a cartridge is fired, force is applied to the face 118 of the bolt 82 by combustion gases in the barrel 30. This force is substantially coaxial with the barrel 30. However, the force of the recoil spring, and some of the force created by the combustion gases, are applied to bolt 82 through the operating rod 46 mounted on top of the bolt 82. Although these forces are applied to the bolt in a direction parallel to the axis of the barrel, they are not coaxial with the barrel 30 and can create non-axial forces on the bolt. The stabilizing rail 134 is helpful to encourage movement of the bolt 82 co-axial with the barrel 30.

Referring to FIGS. 14-15, the exemplary embodiment has a forearm and barrel assembly 28 that includes a barrel 30, forearm cover 32, forearm faceplate 34, barrel locking nut 36, recoil spring 38, recoil spring guide 40, spring cap 135, and gas cylinder 98. The forearm cover 32 includes a forward sight 166 and handguard 168 at the forward end of the forearm cover.

The breach end 56 of barrel 30 includes external threads 100 for engaging the internally threaded barrel receiving portion 54 of the rear barrel mount 24 to securely fasten the barrel 30 to the central assembly 20 as shown in FIGS. 1 and 3. The barrel 30 includes a flange 102, forward of the threads 100, which rests against the face of the rear barrel mount 24 when the barrel 30 is screwed into the rear barrel mount 24.

Figure 16:
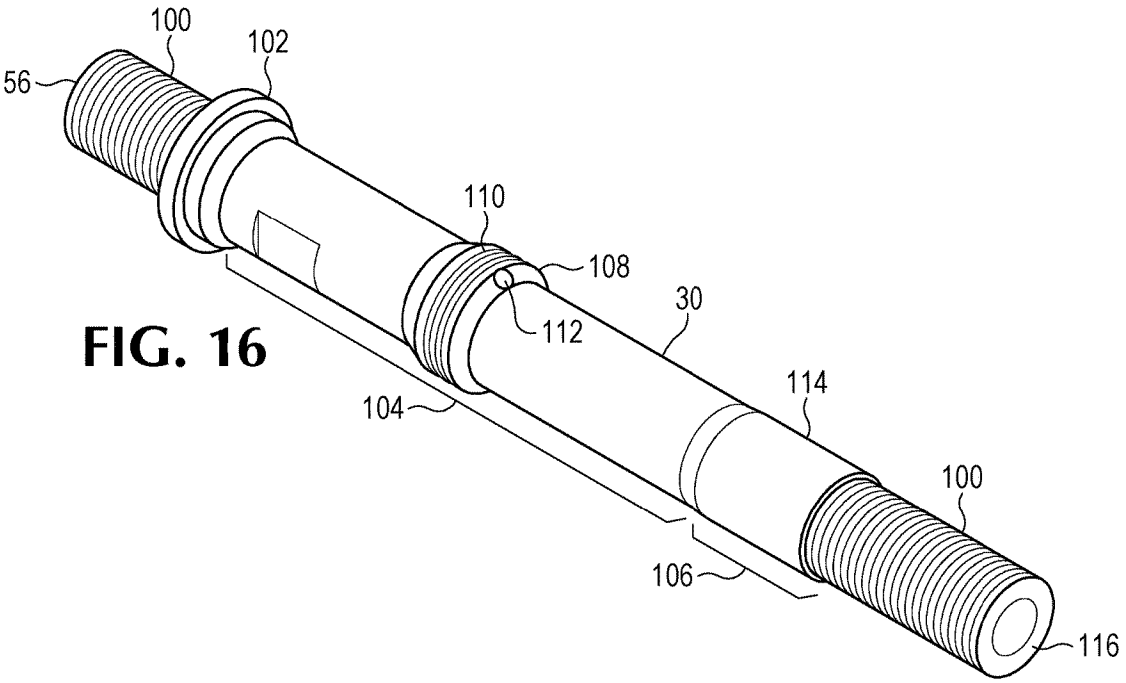
FIG. 16 is a right side perspective view of the barrel of FIG. 14.
Figure 17:
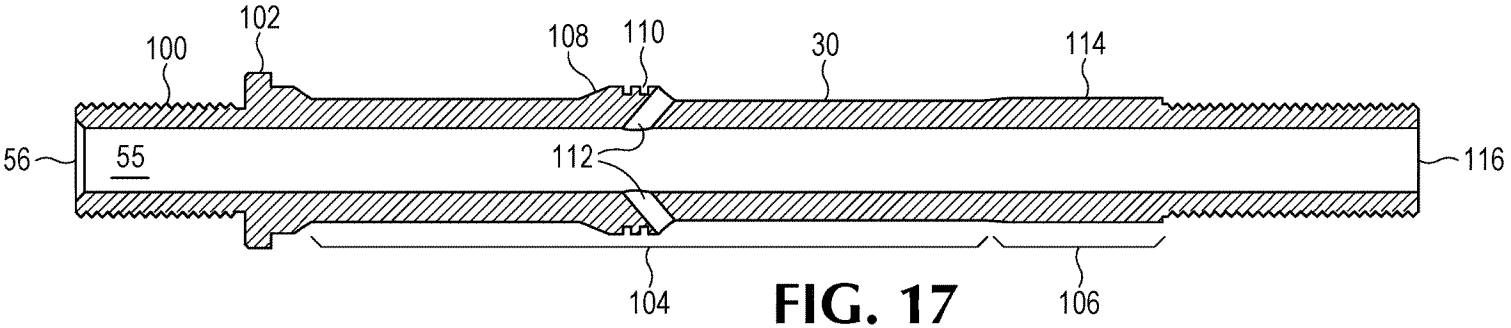
FIG. 17 is a left side cross section view of the barrel of FIG. 14.

Referring to FIGS. 16 and 17, the exemplary barrel 30 includes a mid-section between the threaded breach end 56 and threaded muzzle end 116. The non-threaded portion of the barrel 30 may be further divided into a rearward mid-section 104 and a forward mid-section 106. The rearward midsection 104 of the barrel includes a gas ring 108 having a larger diameter than the diameters of the rearward mid-section 104 both forward and rearward of the gas ring 108. The gas ring 108 includes several annular grooves 110. Gas ports 112 are located on the forward sloping edge of the gas ring 108 forward of the annular grooves. These gas ports 112 communicate with the interior of the barrel. The forward mid-section 106 of barrel 30 includes a thickened portion 114 having a diameter slightly larger than those of the midsection 104, but smaller than the diameter of the gas ring 108. The function of the gas ring 108 and thickened portion 114 of barrel 30 will be explained below. The forward end of the barrel 30 includes a threaded muzzle 116.

Figure 20:
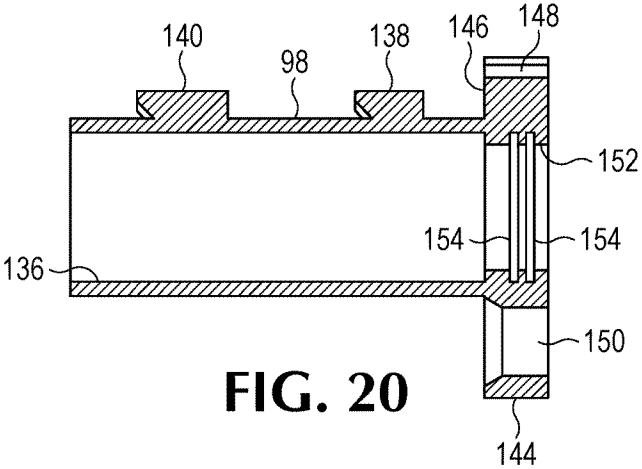
FIG. 20 is a right side cross section view of the gas cylinder of FIG. 14.
Figure 19:
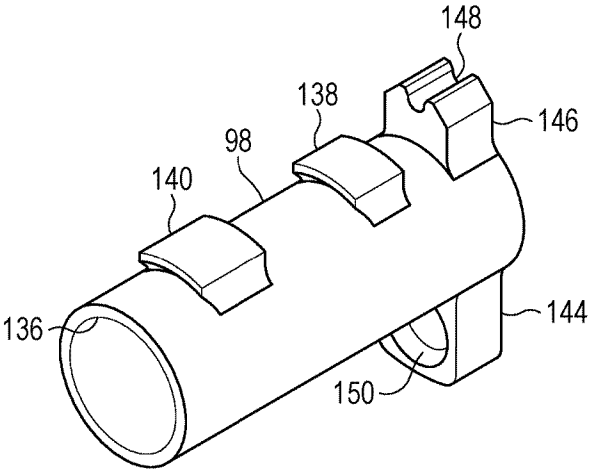
FIG. 19 is a right side perspective view of the gas cylinder shown in FIG. 14.

The exemplary gas cylinder 98 as shown in FIGS. 19 and 20 includes a circular cylinder wall 136, front and rear keys 138 and 140, and a forward face consisting of a chin 144 and a crown 146. The crown 146 has a crease 148 therein to receive the forward end of gas cylinder retaining spring 47. The chin 44 includes a tapered aperture 150 configured to receive the spring cap 135 of recoil spring 38 and block its passage through the aperture 150 yet permit the spring guide 40 to pass through. The spring cap 135, shown in FIG. 14, has a central aperture large enough to permit the spring guide 40 pass through, but small enough to prevent passage of the recoil spring 38. Referring to FIG. 20, the bore of the cylinder 98 includes a choke 152 of reduced diameter in the forward portion of the cylinder 98. In the preferred embodiment, the choke 152 has an annular ridge with grooves 154 formed therein.

As shown in FIGS. 15 and 18, to connect the operating rod 46 to the gas cylinder 98, the keys 138, 140 of the gas cylinder 98 are received in corresponding seats 156, 158 formed in the forward end of the operating rod 46 by rotating the cylinder 98 with respect to the operating rod 46 while the gas cylinder retaining spring 47 is lifted out of the groove 119 in the top of the rod 46 by pressing upward on the forward finger 120. After the keys 138, 140 on the cylinder 98 are seated in the operating rod 46, spring 47 is allowed to return to the groove 119 and is received in the crease 14 preventing the cylinder 98 from rotating out of engagement with the operating rod 46. The rear portion 122 of the spring 47 is securely held by the operating rod 46 by means of a set screw 123. When the gas cylinder 98 is engaged with the operating rod 46, the cylinder 98, rod 46 and bolt 82 move forward and backward as a unit. To disengage the gas cylinder 98 from the operating rod 46, the spring 47 is lifted out of the crease 148 by the forward finger 120, permitting the cylinder 98 to rotate out of engagement with the operating rod 46 by withdrawing the keys 138, 140 from the seats 156 and 158.

AR rifles typically have a butt stock with a buffer and recoil spring to control rearward movement of the bolt 82, push a cartridge into the firing chamber 55 and reseat the bolt 82 at the breech 56. Without a butt stock, buffer, and recoil spring, a different operating system, compatible with a shorter weapon, must be used. The exemplary submachine gun described herein uses a "delayed blowback" self-balancing gas operating system. FIG. 18 shows the bolt 82, operating rod 46, gas cylinder 98, and barrel 30 in ready to fire position. The inner dimensions of the gas cylinder 98 and the outer dimensions of the barrel define an elongate annular chamber 164 between the barrel 30 and the gas cylinder 98. This chamber 164 is in communication with the interior of the barrel 30 via the gas ports 112. The forward end of the annular chamber 164 is substantially sealed by the juxtaposition of the thicker portion 114 of the barrel 30 and the annular choke 152 on the inside of the gas cylinder 98. The rear end of the annular chamber 164 is substantially sealed by the proximity of the gas ring 108 on the barrel 30 to the cylinder wall 136. The gas ports 112 are located on the forward edge of the gas ring 108.

A bullet and air cannot simultaneously occupy the same space. In order for a bullet to move from the firing chamber 55 out of the muzzle 116, it must first push the ambient air out of the barrel. The instant a weapon is fired, expanding combustion gases exert a rearward force on the bolt face 118 and a forward force on the bullet. The initial movement of the bullet down the barrel 30 creates a pressure wave inside the barrel 30 forward of the bullet. Some of the pressurized air in the barrel 30 bleeds into the annular chamber 164 through the gas ports 112. Increased pressure within the annular chamber 164 tends to lock the gas cylinder 98 in the position shown in FIG. 18. Also, the recoil spring 38 pushes forward on the chin 144 of the gas cylinder 98 thereby imparting a forward force on the gas cylinder 98. The combined forces of gas pressure in the annular chamber 164 and the recoil spring 38 are transferred by the cylinder 98 to the bolt 82 via the operating rod 46. Thus, the operating system as described above equalizes the rearward force against the face 118 of the bolt 82 created by combustion gases and the forward forces on the bolt 82 caused by the recoil spring 38 and pressure in the annular chamber 164, to keep the bolt 82 closed against the breech 56 until the bullet exits the barrel 30, at which time the pressures in barrel 30 and annular chamber 164 decrease sufficiently to enable the rearward force on the face 118 of the bolt 82 caused by residual barrel pressure to overcome the forward force of the recoil spring 38 and move the bolt 82, operating rod 46, and gas cylinder 98 rearwardly. The process described above happens very quickly—in the time it takes the bullet to travel the length of the barrel.

The self-balancing pressure system described above allows the exemplary submachine gun to safely handle substandard ammunition from various sources as might be encountered in global conflict despite the differences in pressure duration and intensity that might normally adversely affect other gas operated systems designed to operate with standard ammunition generating standard gas pressure.

As the bolt 82 moves rearwardly within the upper receiver 44, the extractor 84 on the bolt 82 grabs the spent cartridge and withdraws it from the breech 56. In the process, the cartridge strikes the ejector finger 78 which tips it out of grasp of the extractor 84 and out the ejector port 80. With an open breech 56 and open muzzle 116 gas pressure in the barrel 30 dissipates. The compressed recoil spring 38 pushes the gas cylinder 98, operating rod 46 and the bolt 82 forward, the bolt face 118 encounters a live cartridge pressed upwardly into the upper receiver 44 by a magazine spring and pushes the live cartridge into the breech 56 of barrel 30. The weapon is in now in condition to fire again as shown in FIG. 18.

The delayed blow-back operating system of the present invention differs from prior art systems because in prior art delayed blow-back systems the gas cylinder comprises or is connected to an exposed barrel slide or barrel casing, with the slide or casing connected to or formed integrally with the bolt. As a result, the prior art devices have an exposed exterior moving part which includes at least the front sight. Instead, the present invention uses an operating rod 46, shielded within the forearm cover 32 and upper receiver housing 44, to connect the bolt 82 to the gas cylinder 98. As described above, the operating rod 46 passes through a slot 62 in the forearm mounting frame. The front sight and forearm cover 32 do not move when the firearm of the exemplary embodiment is fired.

Although the gas cylinder 98 surrounds the barrel 30, it is not supported by the barrel. Instead, the gas cylinder 98 is supported by the operating rod 46 and bolt 82 assembly which is in turn supported by the stabilizing rail 134. In essence, the entire moving portion of the gas operating system of the exemplary embodiment is supported, at least in part, by the stabilizing rail 134.

The operation of the charging handle 90 is not limited to charging a live cartridge into the breech 56 of barrel 30 as explained above. When the operating rod 46 is detached from gas cylinder 98 as described above, the charging handle 90 may be used to remove the bolt 82 and operating rod 46 from the weapon. As the charging handle 90 is drawn back and out of the upper receiver 42, the slot 94 on the tongue 90 catches the post 96 on the ridge 95 of the operating rod 46 and draws the bolt 82 and operating rod out of the rear of the upper receiver housing 44.

The invention is described herein as a conversion unit built upon a prior art lower receiver containing a fire control group such as trigger and hammer mechanisms, safety, fire selector. However, with its own fire control group, the conversion unit would constitute a complete weapon.

Without the magazine well 22, the conversion unit as described herein could be used to convert an AR style or other assault rifle to an automatic weapon with different operating characteristics, but firing the same ammunition for which the rifle was designed.

Although the conversion unit has been described herein with respect to an AR style weapon, it could be adopted to be used with a lower receiver or fire control unit of other weapons.

Although the conversion unit has been described with respect to commonly used materials such as steel and aluminum, the unit is not confined to these materials. Other metals, or non-metallic materials such as carbon fiber, polymers or plastics, may be used instead of or in combination with steel and aluminum. An obvious example is a non-metallic component with metallic or hardened wear surfaces.

While the foregoing is directed toward an exemplary embodiment of the present invention, other and further embodiments of the invention may be devised without departing from the scope thereof which is defined by the claims. For example, the invention has been described with respect to a 9 mm cartridge. The conversion unit may be adapted to other size cartridges smaller in length than the cartridge for which the initial weapon was devised.

I claim:

1. A conversion unit for converting a military assault rifle to a submachine gun wherein said assault rifle includes a lower receiver having a magazine chamber for receiving a first magazine therein, said magazine chamber having an open top and an open bottom; said conversion unit comprising:

a. a magazine well having portion which fits snugly into said magazine chamber;

b. a rear barrel mount including an aperture capable of receiving a breech end of a barrel within said aperture;

c. an upper receiver connected to said lower receiver;

d. a forearm and barrel assembly connected to said rear barrel mount, wherein said magazine well is rigidly interconnected with said rear barrel mount.

2. The conversion unit of claim 1, wherein said magazine well includes an upper portion which fits snugly into said magazine chamber and a lower portion which extends below said magazine chamber.

3. The conversion unit of claim 1, wherein at least a portion of said magazine well and at least a portion of said rear barrel mount are integrally formed from the same single body of substantially uniform material.

4. The conversion unit of claim 1, wherein said forearm and barrel assembly includes a forearm cover and said upper receiver includes a housing, said conversion unit further including an operating rod extending within said housing and said forearm cover.

5. The conversion unit of claim 4, further including a recoil spring within said forearm cover.

6. The conversion unit of claim 1, wherein said military assault rifle has a first caliber and said submachine gun has a second caliber different from said first caliber.

7. A rigid central assembly for converting a lower receiver of a firearm to accommodate cartridges of a shorter length than initially provided for by said lower receiver wherein said lower receiver includes a magazine chamber, said central assembly comprising:

a. a magazine well defining a well cavity sized to accept a magazine of said shorter cartridges, at least a portion of said well fitting snugly into said magazine chamber of said lower receiver;

b. a rear barrel mount including an aperture capable of receiving a breach end of a barrel within said aperture, said rear barrel mount rigidly interconnected with said magazine well.

8. The central assembly of claim 7, wherein said rear barrel mount is threaded.

9. The central assembly of claim 7, including an interconnecting member rigidly interconnecting said magazine well to said rear barrel mount.

10. The central assembly of claim 9, wherein at least a portion of said central assembly sits atop said lower receiver when said well is positioned in said magazine chamber.

11. The central assembly of claim 7, wherein said well has a lower portion which extends below said magazine chamber when said well is received within said magazine chamber.

12. The central assembly of claim 11, wherein said lower portion of said well body includes a magazine latch for retaining a magazine in said well.

13. The central assembly of claim 7, wherein at least a portion of said well and at least a portion of said rear barrel mount are integrally formed from a single body of substantially uniform material.

14. The central assembly of claim 7, wherein said lower receiver has a magazine catch extending into said magazine chamber, said well including an aperture for engagement with said magazine catch.

15. The central assembly of claim 14, wherein said magazine catch is capable of engaging a magazine within said well when said well is received in said lower receiver magazine chamber.

16. The central assembly of claim 7, wherein said magazine well is rigidly fastened directly or indirectly to said rear barrel mount.

17. A magazine well for enabling a lower receiver of a firearm to accommodate cartridges of a shorter length than initially provided for by said lower receiver, said lower receiver having a magazine chamber for accepting a first magazine of a first size, said magazine chamber having an open top and an open bottom, said magazine well defining a well cavity sized to accept a second magazine of a second size shorter front to back than said first magazine and suitable for shorter cartridges, said well having an upper portion and a lower portion, said upper portion of said well sized to closely fit within said magazine chamber, said lower portion of said well extending below said open bottom of said magazine chamber when said upper portion is fitted within said magazine chamber.

18. The magazine well of claim 17, wherein said lower portion of said well extending below said magazine chamber is serviceable as a hand grip when operating said firearm.

19. The magazine well of claim 17, wherein said lower portion of said well has finger grip features.

20. The magazine well of claim 17, wherein said lower portion of said well includes an operable latch for releasably retaining said second magazine within said well.

21. The magazine well of claim 17, wherein said lower receiver has an operable magazine catch for releasably retaining said first magazine in said lower receiver magazine chamber, said upper portion of said well having a side wall with an aperture therein positioned for cooperating with said operable magazine catch of said lower receiver when said well is in said magazine chamber to attach said well body to said magazine chamber.

22. The magazine well of claim 21, wherein said magazine well is free of attachment to said lower receiver except for cooperation of said magazine catch and said aperture in said magazine well.

* * * * *